US006764360B2

(12) United States Patent
Tanaka et al.

(10) Patent No.: US 6,764,360 B2
(45) Date of Patent: Jul. 20, 2004

(54) PERSONAL WATERCRAFT

(75) Inventors: Yoshinobu Tanaka, Hyogo (JP); Toshio Araki, Kakogawa (JP); Yoshimoto Matsuda, Kobe (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 10/159,249

(22) Filed: May 29, 2002

(65) Prior Publication Data

US 2002/0182949 A1 Dec. 5, 2002

(30) Foreign Application Priority Data

May 30, 2001 (JP) ..... 2001-161801

(51) Int. Cl.[7] ..... B63H 21/10
(52) U.S. Cl. ..... 440/88 C
(58) Field of Search ..... 440/88 C, 88 D, 440/88 M, 88 N, 88 P, 88 R, 38, 88; 210/94

(56) References Cited

U.S. PATENT DOCUMENTS 4,787,328 A * 11/1988 Inoue ..... 114/183 R
4,863,591 A * 9/1989 Dionne ..... 210/94
5,472,359 A * 12/1995 Allbright et al. ..... 440/38
5,683,277 A * 11/1997 Tsunoda et al. ..... 440/88
5,788,547 A * 8/1998 Ozawa et al. ..... 440/89
5,885,121 A * 3/1999 Nanami et al. ..... 440/88
6,171,158 B1 * 1/2001 Henmi et al. ..... 440/38
6,224,439 B1 * 5/2001 Sato et al. ..... 440/88
6,244,913 B1 * 6/2001 Matsumoto et al. ..... 440/38
6,312,300 B1 * 11/2001 Asai ..... 440/88
6,331,127 B1 * 12/2001 Suzuki ..... 440/88 R

* cited by examiner

*Primary Examiner*—Andrew Wright
(74) *Attorney, Agent, or Firm*—Kolisch Hartwell, P.C.

(57) ABSTRACT

Disclosed is a personal watercraft comprising: a water jet pump including an outlet port, the water jet pump pressurizing and accelerating sucked water and ejecting the water from the outlet port to propel the watercraft as a reaction of the ejecting water; a riding seat; a water-cooled engine placed in an engine room below the seat, for driving the water jet pump; a supply passage through which a cooling water is supplied from outside of the watercraft to the engine; and a filter provided in the supply passage for filtering substances in the cooling water.

9 Claims, 9 Drawing Sheets

PERSONAL WATERCRAFT

BACKGROUND OF THE INVENTION

1. Field of the Invention

The present invention relates to a jet-propulsion personal watercraft (PWC) which ejects water rearward and planes on a water surface as the resulting reaction. More particularly, the present invention relates to a personal watercraft comprising an engine cooling system adapted to discharge cooling water in an engine to outside of the engine after use.

2. Description of the Related Art

In recent years, so-called jet-propulsion personal watercraft have been widely used in leisure, sport, rescue activities, and the like. The jet-propulsion personal watercraft is configured to have a water jet pump that pressurizes and accelerates water sucked from a water intake generally provided on a bottom of a hull and ejects it rearward from an outlet port. Thereby, the personal watercraft is propelled.

In the jet-propulsion personal watercraft, a steering nozzle provided behind the outlet port of the water jet pump is swung either to the right or to the left, to change the ejection direction of the water to the right or to the left, thereby turning the watercraft to the right or to the left.

In the jet-propulsion personal watercraft, a base end of a supply passage of the cooling water is connected to a pressurizing portion of the water jet pump and a tip end of the supply passage is connected to a cooling water supply port of the engine so that part of the water pressurized by the water jet pump is branched and supplied to a cooling water supply passage of the engine. In such a constitution, since the water intake is provided on the bottom of the watercraft, sand, waterborne plants, dust, substances, or the like are sometimes sucked into the water jet pump and the cooling water supply passage of the engine which is connected to the pump, through the water intake.

It is preferred that the cooling water in the engine be discharged outside after use for prevention of corrosion of the inside of a water jacket of the engine. In some cases, however, the cooling water in the engine is difficult to discharge outside, depending on the constitution of the cooling water supply passage.

SUMMARY OF THE INVENTION

The present invention addresses the above described condition, and an object of the present invention is to provide a personal watercraft that offers easy inspection and maintenance and is capable of preventing substances mixed in cooling water from going into an engine side, and also easily allows discharge of the cooling water from the engine after use.

According to the present invention, there is provided a personal watercraft comprising: a water jet pump including an outlet port, the water jet pump pressurizing and accelerating sucked water and ejecting the water from the outlet port to propel the watercraft as a reaction of the ejecting water; a riding seat; a water-cooled engine placed in an engine room below the seat, for driving the water jet pump; a supply passage through which cooling water is supplied from outside of the watercraft to the engine; and a filter provided in the supply passage for filtering substances in the cooling water.

In the personal watercraft so constituted, since the substances in the cooling water such as sand can be eliminated by the filter provided in the supply passage of the cooling water, entry of the substances into the engine can be prevented.

It is preferable that, in the personal watercraft, a tip end of the supply passage is connected to a cooling water supply port of the engine and the supply passage extending from a connecting portion to the cooling water supply port toward a base end of the supply passage is positioned so as to be as high as or lower than the cooling water supply port. In the personal watercraft so constituted, after cruising, the cooling water in the engine is discharged by its gravity toward the supply passage. Since there is no cooling water in the engine after use, the corrosion in the water jacket of the engine, which would be caused by the cooling water that resides in the engine, can be prevented.

It is preferable that the personal watercraft further comprises an opening provided in a body of the watercraft under the seat, the riding seat is removably provided so as to cover the opening in the body of the watercraft and the filter is placed so as to be visible through the opening when the riding seat is removed. In this constitution, the filter requiring inspection and cleaning, can be easily inspected and cleaned by removing the riding seat.

It is preferable that, in the personal watercraft, the filter is provided on a pump casing placed behind the engine. This constitution enables the filter to be easily inspected and cleaned.

It is preferable that, in the personal watercraft, the supply passage has a protruded portion curved so as to be partially protruded upwardly toward the opening in the body and the filter is provided on a top portion of the protruded portion. This constitution enables the filter to be easily inspected and cleaned.

It is preferable that, in the personal watercraft, a tip end of the supply passage is connected to a first cooling water supply port of the engine and a bypass passage that bypasses at least the protruded portion is provided so as to be as high as or lower than the first cooling water supply port. The cooling water in the engine is discharged by its gravity to the outside of the watercraft through the bypass passage. As a result, since there is no cooling water left in the engine after use, the corrosion in the water jacket of the engine, which would be caused by the cooling water that resides in the engine, can be prevented.

It is preferable that, in the personal watercraft, the bypass passage has a flow cross-sectional area smaller than a flow cross-sectional area of the supply passage. Thereby, without occluding the bypass passage during engine operation, substances such as sand in the cooling water supplied from outside the watercraft to the engine can be suppressed with a simple constitution.

It is preferable that, in the personal watercraft, a one-way valve is provided in the bypass passage to permit only a flow from an engine side. This constitution is capable of preventing the substances from going into the engine through the bypass passage.

It is preferable that, in the personal watercraft, both ends of the bypass passage are connected to the supply passage, and a flow passage extending from a connecting portion to the first cooling water supply port toward a base end of the supply passage through the bypass passage is positioned so as to be as high as or lower than the first cooling water supply port.

It is preferable that, in the personal watercraft, one end of the bypass passage is connected to the supply passage between the protruded portion of the supply passage and the tip end of the supply passage and the other end thereof communicates with outside of the watercraft, and a flow passage extending from the first cooling water supply port to the outside of the watercraft through the supply passage and the bypass passage is positioned so as to be as high as or lower than the first cooling water supply port.

It is preferable that the personal watercraft further comprises a second cooling water supply port of the engine, and one end of the bypass passage is connected to the second cooling water supply port and the other end thereof is connected to the supply passage between the protruded portion and a base end of the supply passage, and a flow passage extending from the second cooling water supply port to the outside of the watercraft through the bypass passage and the supply passage is positioned so as to be as high as or lower than the second cooling water supply port.

It is preferable that the personal watercraft further comprises a second cooling water supply port of the engine, and the bypass passage is provided between the second cooling water supply port and the outside of the watercraft so as to be as high as or lower than the second cooling water supply port.

It is preferable that, in the personal watercraft, at least a part of a casing of the filter is comprised of a member through which filtering residue remaining in the filter is visible. Thereby, whether or not the filter should be cleaned can be easily checked from outside.

It is preferable that, in the personal watercraft, the filter is removably mounted, because the filter can be easily removed and cleaned.

It is preferable that, in the personal watercraft, the water jet pump is used as a cooling water supply pump for supplying the cooling water to the supply passage. This constitution is rational because there is no need for an additional cooling water supply pump. Further, after cruising, the cooling water in the engine can be easily discharged through the water jet pump as the cooling water supply pump.

The above and further objects and features of the invention will more fully be apparent from the following detailed description with accompanying drawings.

BRIEF DESCRIPTION OF THE DRAWINGS

FIGS. 3A, 3B are views showing placement of a filter in the engine cooling system of FIG. 1, in which FIG. 3A is an enlarged side view and FIG. 3B is a view taken in the direction of arrows along line IIIB—IIIB of FIG. 3A;

FIGS. 5A, 5B are views showing placement of a filter in an engine cooling system according to a third embodiment of the present invention, in which FIG. 5A is a partially enlarged view seen from the direction of the side of the personal watercraft and FIG. 5B is a view taken in the direction of arrows along line VB—VB of FIG. 5A;

DETAILED DESCRIPTION OF THE PREFERRED EMBODIMENTS

Hereinafter, preferred embodiments of the present invention will be described with reference to drawings.

(Embodiment 1)

A first embodiment of the present invention illustrates a jet-propulsion personal watercraft as an example of a jet-propulsion watercraft.

Figure 1:
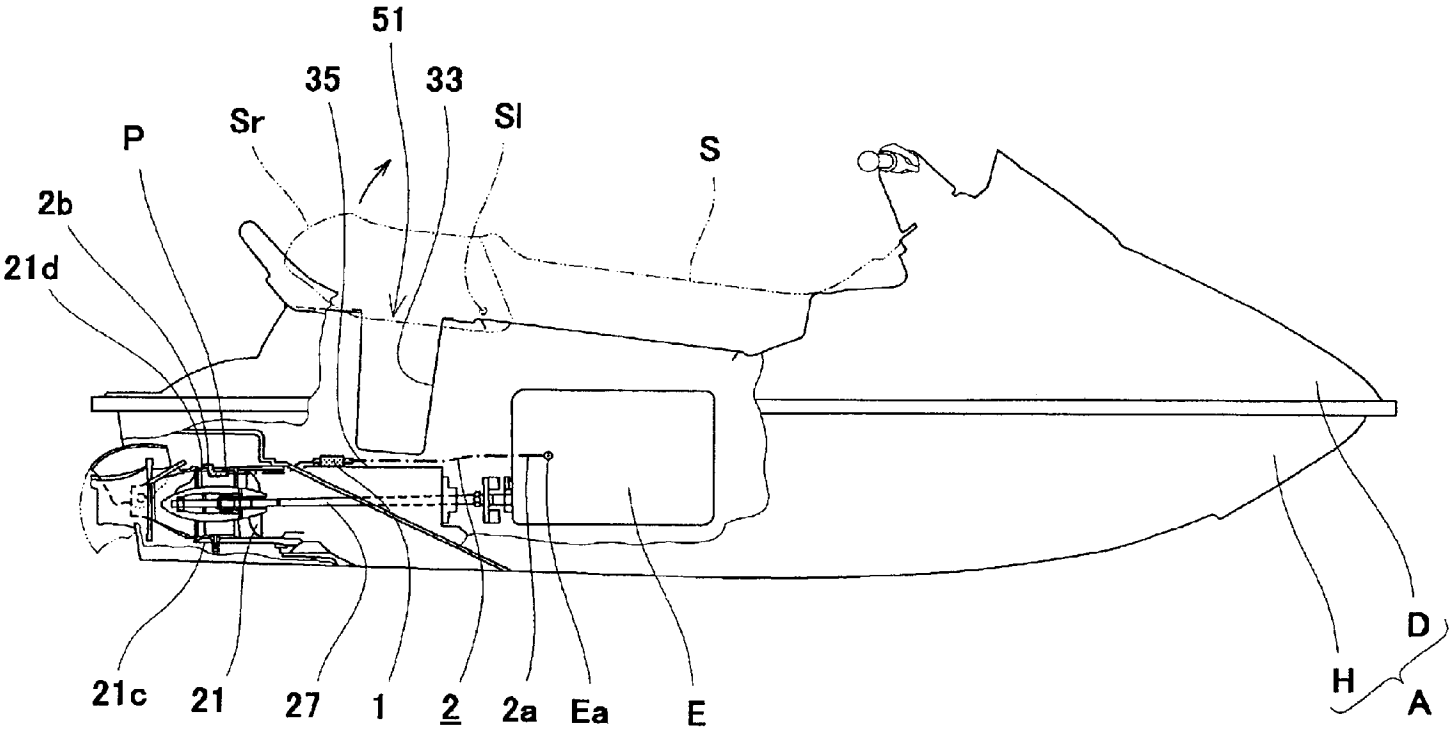
FIG. 1 is a side view schematically showing an entire engine cooling system of a jet-propulsion personal watercraft according to a first embodiment of the present invention.
Figure 2:
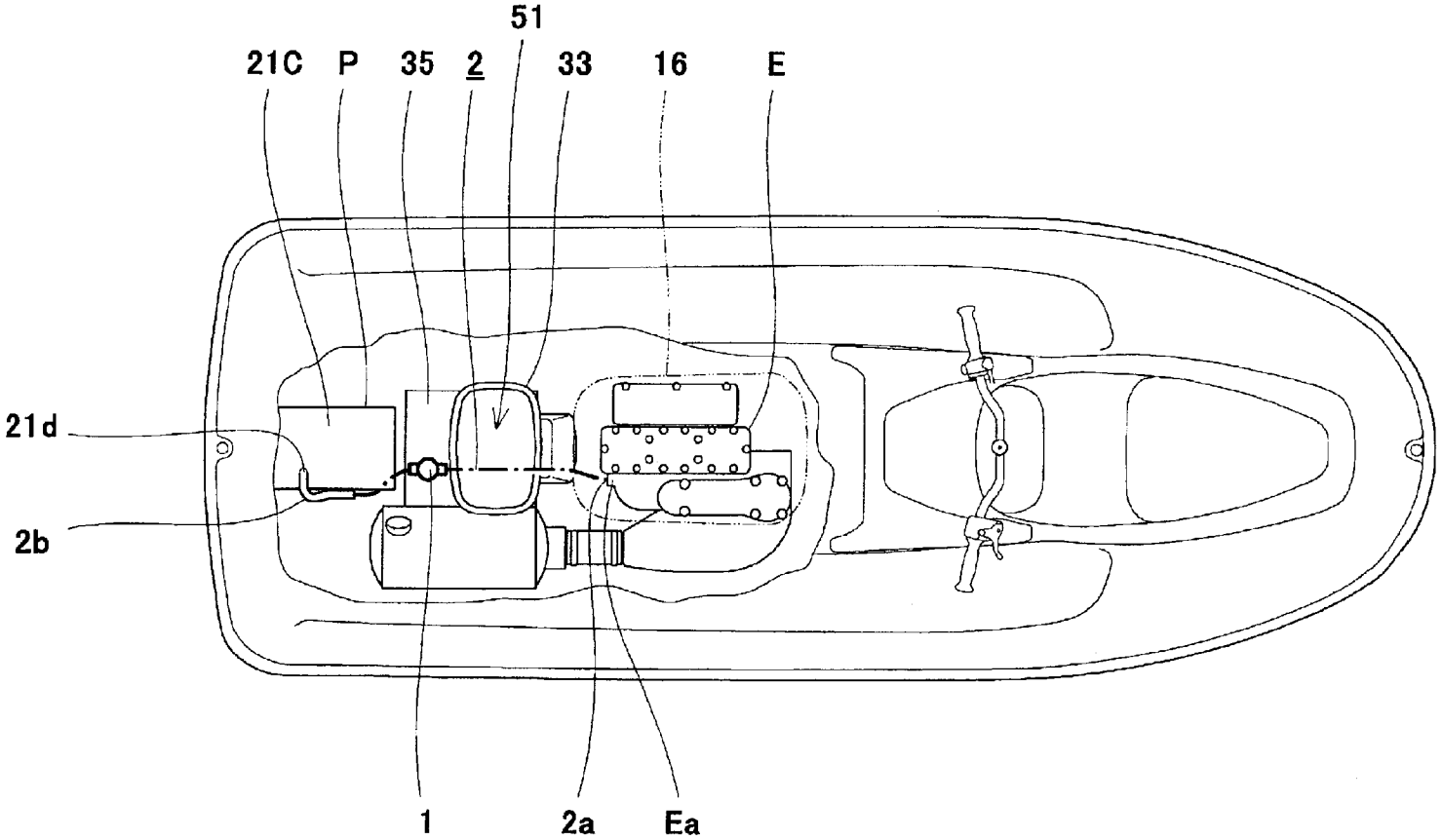
FIG. 2 is a plan view schematically showing the entire engine cooling system of FIG. 1.
Figure 3B:
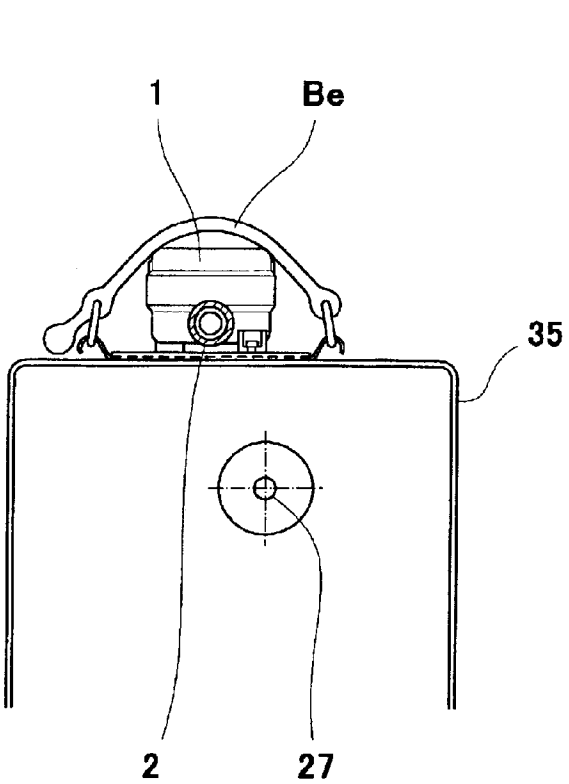
Figure 3A:
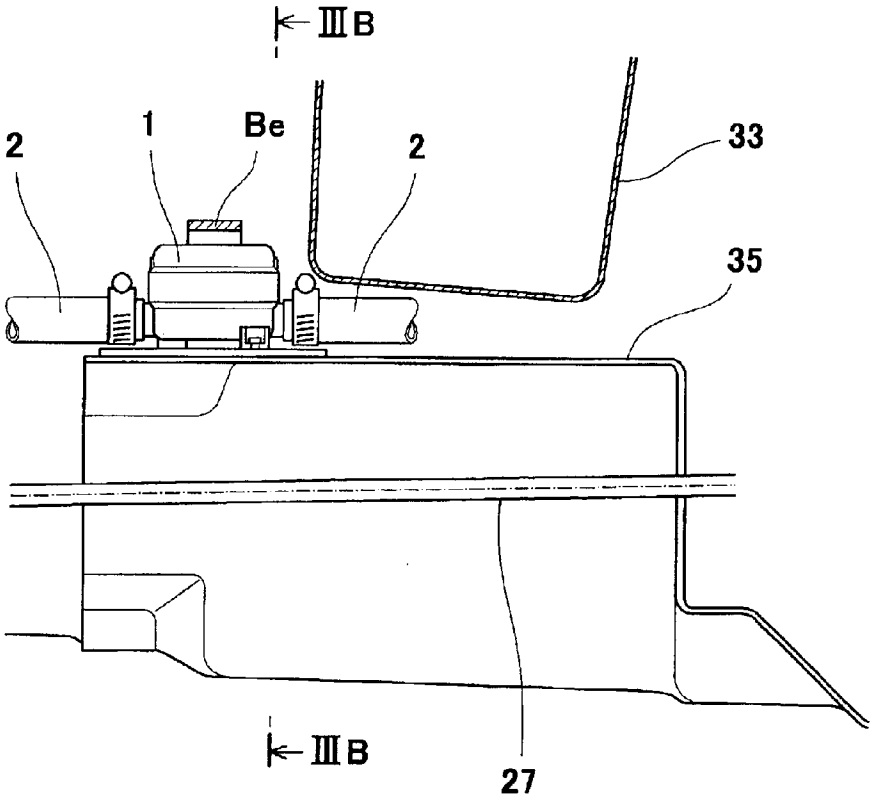
Figure 10:
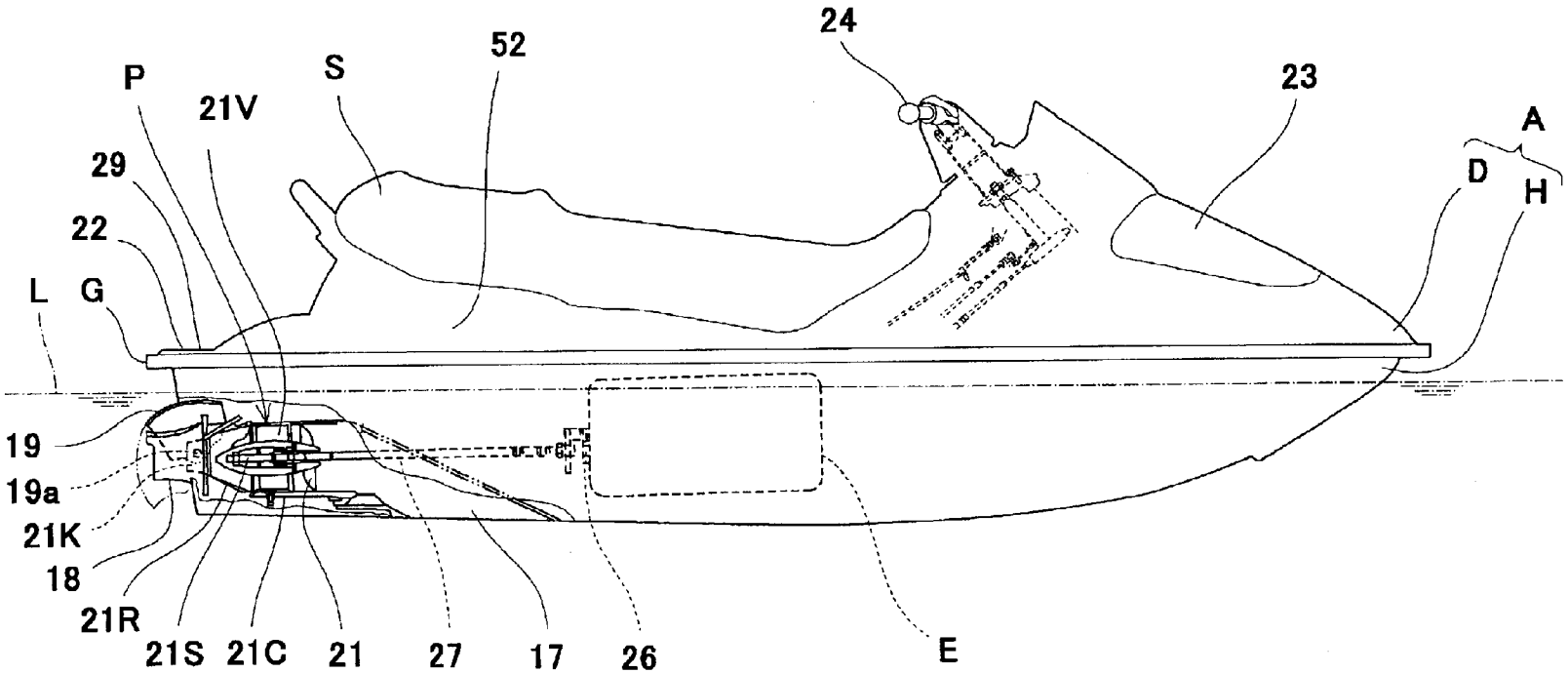
FIG. 10 is a side view showing an entire jet-propulsion personal watercraft according to the first embodiment of the present invention.
Figure 11:
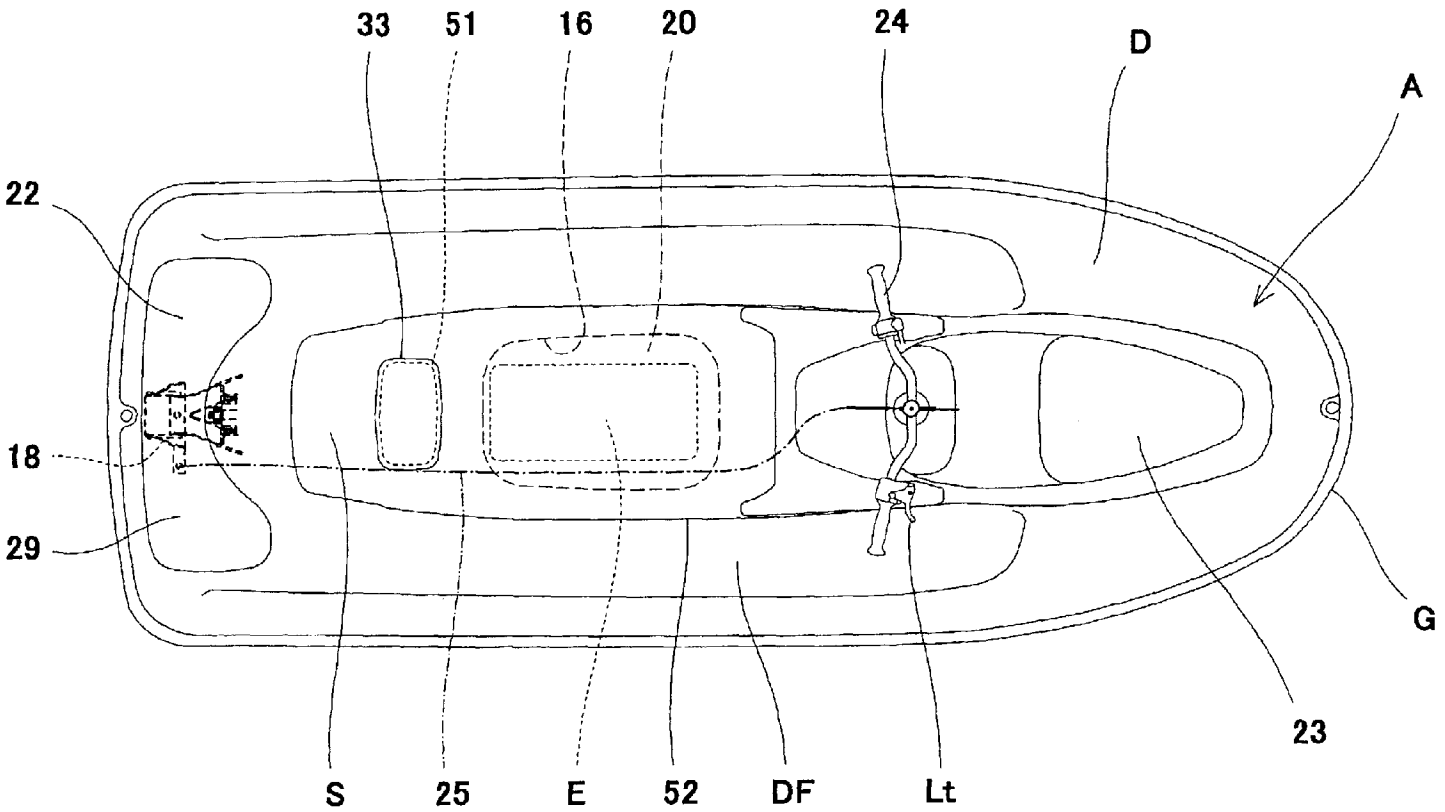
FIG. 11 is a plan view showing the entire jet-propulsion personal watercraft according to the first embodiment.

FIG. 1 is a side view schematically showing an entire engine cooling system of a jet-propulsion personal watercraft according to a first embodiment of the present invention. FIG. 2 is a plan view schematically showing the entire engine cooling system of FIG. 1. FIGS. 3A, 3B are views showing placement of a filter of the engine cooling system of FIG. 1, in which FIG. 3A is a partially enlarged side view and FIG. 3B is a view taken in the direction of arrows along line IIIB—IIIB. FIG. 10 is a side view showing an entire jet-propulsion personal watercraft according to the first embodiment of the present invention. FIG. 11 is a plan view showing the entire jet-propulsion personal watercraft.

First of all, a schematic constitution of the jet-propulsion personal watercraft (hereinafter, simply referred to as a personal watercraft) according to the embodiments of the present invention will be described.

Referring now to FIGS. 10, 11, reference numeral A denotes a body of the personal watercraft. The body A comprises a hull A and a deck D covering the hull H from above. A line at which the hull H and the deck D are connected over the entire perimeter thereof is called a gunnel line G. In this embodiment, the gunnel line G is located above a waterline L of the personal watercraft. The waterline L is a waterline of the watercraft which is not cruising. In this personal watercraft, an imaginary horizontal plane (hereinafter referred to as an imaginary horizontal plane) for defining a horizontal attitude of the personal watercraft is assumed in design. In this embodiment, the imaginary horizontal plane is a flat plane including the waterline L. Herein, the vertical level of respective parts of the personal watercraft is represented on the basis of the imaginary horizontal plane.

As shown in FIG. 11, an opening 16, which has a substantially rectangular shape seen from above, is formed at a relatively rear section of the deck D such that it extends in the longitudinal direction of the body A, and a riding seat S is provided above the opening 16 such that it covers the opening 16 from above as shown in FIGS. 10, 11.

An engine E is provided in a chamber 20 (engine room) surrounded by the hull H and the deck D below the seat S. The engine E includes multiple cylinders (e.g., four-cylinders). As shown in FIG. 10, a crankshaft 26 of the engine E is mounted along the longitudinal direction of the body A. An output end of the crankshaft 26 is rotatably coupled integrally with a pump shaft 21S of a water jet pump P through a propeller shaft 27. An impeller 21 is mounted on the pump shaft 21S. The impeller 21 is covered with a pump casing 21C on the outer periphery thereof. A water intake 17 is provided on the bottom of the hull H. The water is sucked from the water intake 17 and fed to the water jet pump P through a water intake passage. The water jet pump P pressurizes and accelerates the water by rotation of the impeller 21. The pressurized and accelerated water is discharged through a pump nozzle 21R having a cross-sectional area of flow gradually reduced rearward, and from an outlet port 21K provided on the rear end of the pump nozzle 21R, thereby obtaining a propulsion force. In FIG. 11, reference numeral 21V denotes fairing vanes for fairing water flow behind the impeller 21.

As shown in FIGS. 10, 11, reference numeral 24 denotes a bar-type steering handle as a steering operation means. The handle 24 is connected to a steering nozzle 18 provided behind the pump nozzle 21R through a cable 25. The handle 24 is operated to the right or to the left in association with the steering nozzle 18 provided behind the pump nozzle 21R such that the steering nozzle 18 is swingable to the right or to the left. The watercraft can be turned to any desired direction while the water jet pump P is generating a propulsion force. A throttle lever Lt is provided in the vicinity of a right grip of the handle 24 for controlling an engine speed.

As shown in FIG. 10, a bowl-shaped reverse deflector 19 is provided above the rear side of the steering nozzle 18 such that it can swing downward around a horizontally mounted swinging shaft 19*a*. The deflector 19 is swung downward toward a lower position behind the steering nozzle 18 to deflect the water ejected from the steering nozzle 18 forward, and as the resulting reaction, the personal watercraft moves rearward.

In FIGS. 10, 11, reference numeral 22 denotes a rear deck. The rear deck 22 is provided with an openable hatch cover 29. A rear compartment with a small capacity is provided under the hatch cover 29. In FIG. 10 or 11, reference numeral 23 denotes a front hatch cover. A front compartment (not shown) is provided under the front hatch cover 23 for storing equipment and the like.

Subsequently, an engine cooling system will be described in detail.

The personal watercraft according to the first embodiment of the present invention, comprises an engine cooling system shown in FIGS. 1–3. In the engine cooling system, the water jet pump P serves as a cooling water supply pump of the engine E. Specifically, there is provided a discharge port 21*d* in a casing 21*c* of the waterjet pump P on a rear flow side of the impeller 21, and a supply pipe 2 is provided between the discharge port 21*d* and a cooling water supply port Ea of the engine E. The supply pipe 2 serves as the supply passage of the cooling water of the engine E. A base end 2*b* of the supply pipe 2 is connected to the discharge port 21*d* and a tip end 2*a* thereof is connected to the cooling water supply port Ea. As a feature of the present invention, a filter 1 made of semi-transparent resin is provided at an intermediate portion of the supply pipe 2. In this embodiment, the filter 1 is placed on an upper surface of a pump cover 35. The pump cover 35 is located slightly forward of the water jet pump P and serves as a cover for the propeller shaft 27. As shown in FIG. 3B, the filter 1 is removably mounted on the pump cover 35 by means of a rubber belt Be. As shown in FIG. 1, a flow passage extending from a connecting portion (the tip end portion 2*a* of the supply pipe 2) to the cooling water supply port Ea of the supply pipe 2 toward the base end 2*b*, including the filter 1, is positioned so as to be as high as or lower than that of the tip end portion 2*a*. In other words, the tip end portion 2*a* connected to the cooling water supply port Ea of the engine E is the highest and a portion extending from the tip end portion 2*a* toward the discharge port 21*d* of the water jet pump P, including the filter 1, is positioned so as to be lower than the tip end portion 2*a*.

As shown in FIGS. 1 and 2, the filter 1 is placed so as to be visible from above, when the riding seat S is removed. More specifically, a rear portion Sr of the riding seat S is upwardly (i.e., forwardly) swingable around a pivot S1 provided at a front end portion of the rear portion Sr. An opening 51 is provided in an upper surface of the body A (deck D) as covered by the rear portion Sr of the riding seat S and a container case 33 is fitted into the opening 51. The filter 1 is placed in the vicinity of the container case 33 (behind a bottom of the container case 33). Therefore, by upwardly swinging the rear portion Sr of the riding seat S and taking out the container case 33 fitted into the opening 51, the filter 1 becomes visible from above.

In the personal watercraft so constituted, the cooling water is supplied from the water jet pump P to the engine E through the supply pipe 2 while the water jet pump P is operating. During this supply, sand, waterborne plants, or the like contained in the cooling water is eliminated by the filter 1 provided in the supply pipe 2, thereby allowing clean cooling water to be supplied to the engine E.

After cruising the personal watercraft for a while, when the rear portion Sr of the riding seat S is upwardly swung around the pivot S1 and the container case 33 in the body A is taken out from the opening 51, the filter 1 becomes visible from above. Since the filter 1 is made of the semi-transparent resin, filtering residue of sand or the like remaining in the filter 1 can be visually checked. If the filter 1 needs to be washed, the filter 1 is taken out from the opening 51 to be cleaned. The cleaned filter 1 can be easily re-mounted at its original position. The filter 1 can be removed easily and quickly by merely removing the rubber belt Be.

When the personal watercraft so constituted is landed after cruising and horizontally placed (i.e., the imaginary plane is horizontal), the cooling water in the engine E is caused to travel through the supply pipe 2 and is discharged toward the water jet pump P due to a vertical level difference. Therefore, no cooling water is left in the water jacket of the engine E.

(Embodiment 2)

Figure 4:
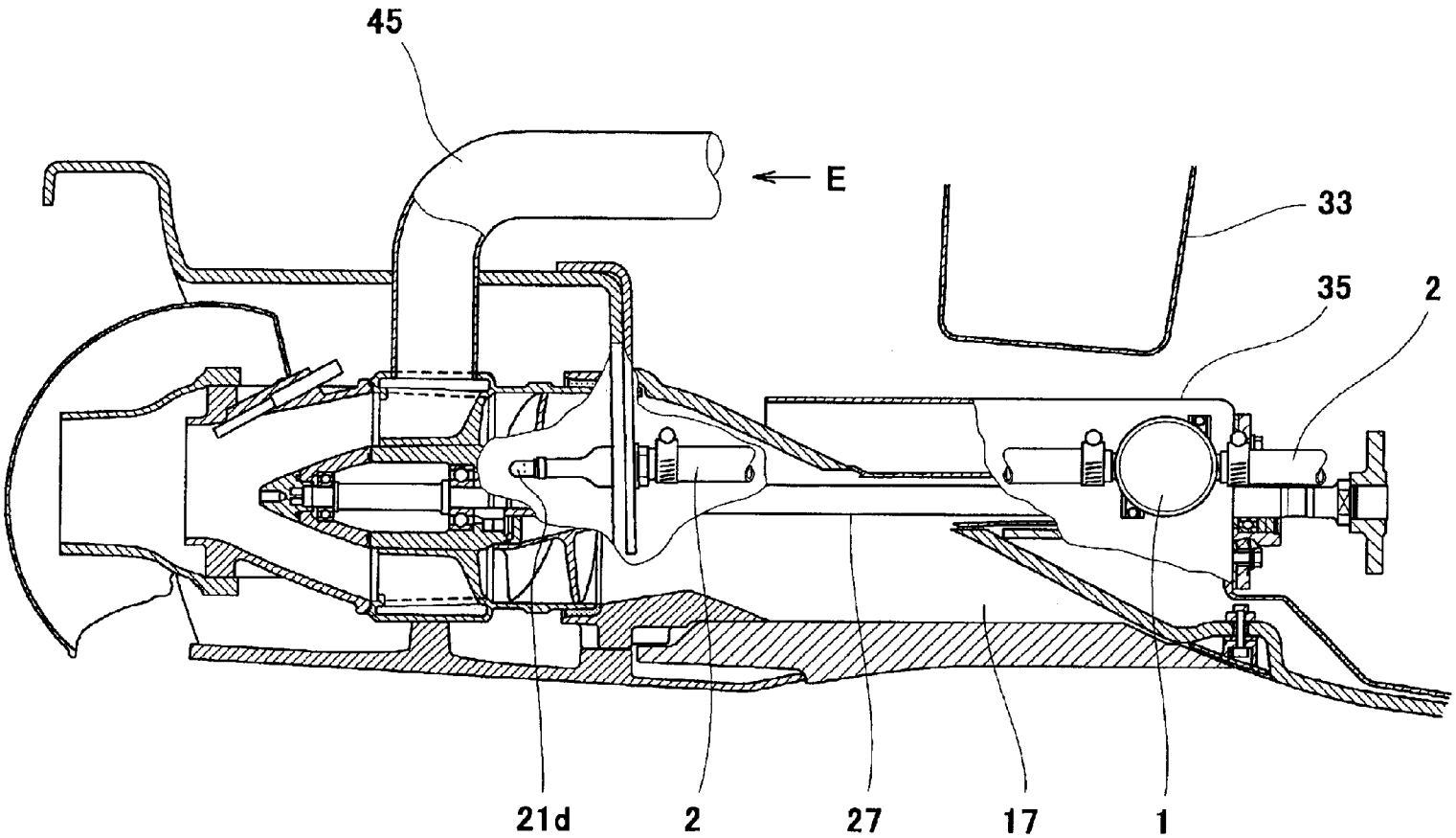
FIG. 4 is a partially enlarged view showing placement of a filter according to a second embodiment of the present invention.

In this embodiment, the filter 1 of the first embodiment is positioned on a side surface of the pump cover 35 as shown in FIG. 4. In this embodiment, the filter 1 is screwed to the pump cover 35 by means of screws.

The second embodiment has basically the same structure, functions, and effects as the first embodiment, except that the filter 1 is placed at a different position and removably mounted by means of the screws, and the discharge port 21*d* is provided at a different position. In FIG. 4, reference numeral 45 denotes an exhaust pipe having a base end connected to the engine E. The same reference numerals as those in FIGS. 1–3 are used in FIG. 4 to indicate the same or corresponding parts, which will not be further described.

(Embodiment 3)

Figure 5A:
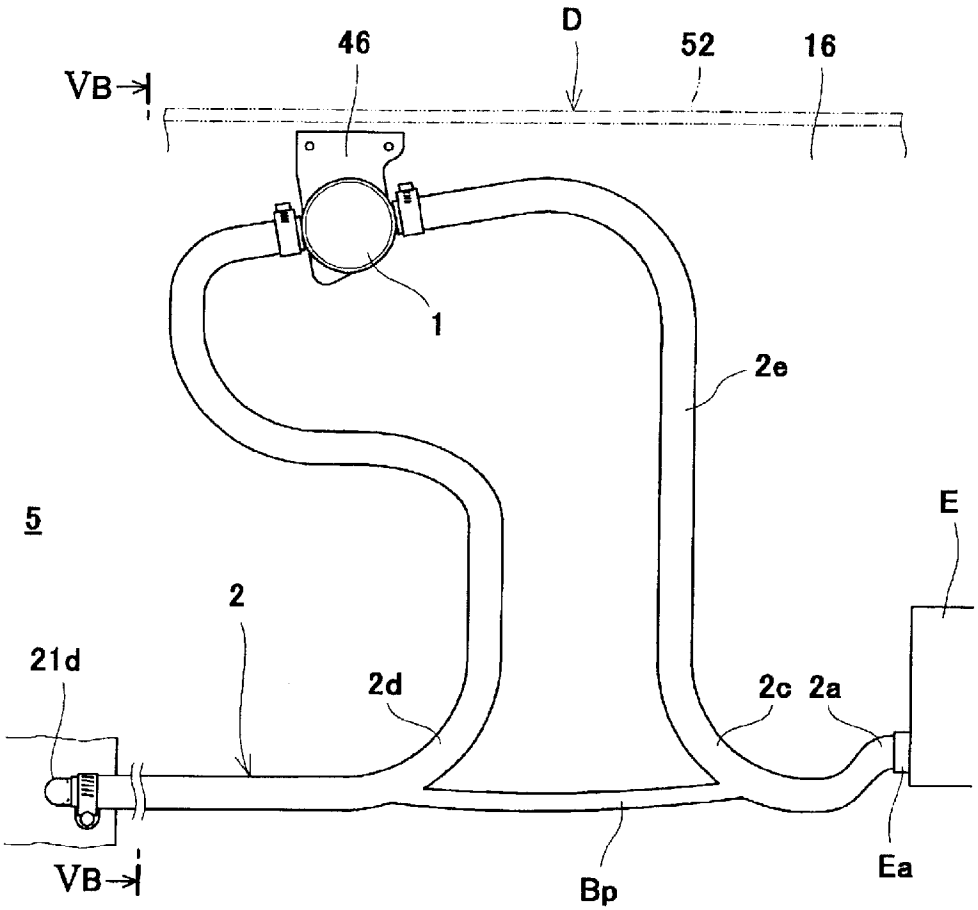
Figure 5B:
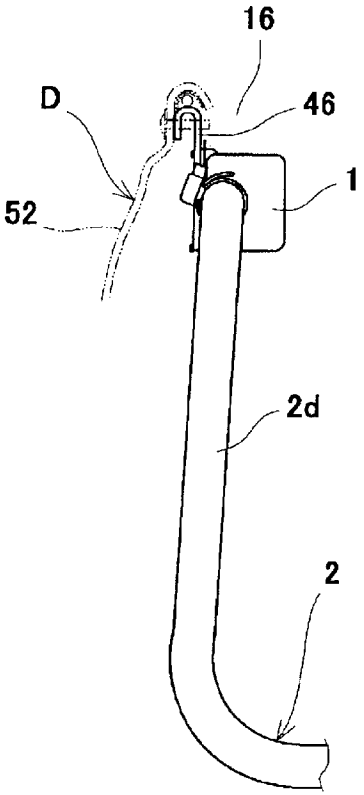

A third embodiment will be described with reference to FIG. 5. In the third embodiment of FIG. 5, the filter 1 is provided in the vicinity of the opening 16 which appears when the riding seat S (see FIGS. 10, 11) is removed so that the filter 1 is easy to see and remove. Although in FIG. 5, for clarity, the filter 1 is drawn as apart from the engine E, it is actually close to the engine E. The filter 1 is located in the opening 16 as seen in a plan view. For greater detail, as shown in FIGS. 5, 10, 11, the deck D is configured such that a portion 52 where the riding seat S is placed is swelled from its periphery (deck floor D F shown in FIG. 11) and the filter 1 is provided on an inner surface of a side wall of the swelled portion 52 of the deck D (on the right side of the deck D). In this embodiment, as shown in FIG. 5A, the supply pipe 2 is curved so as to be partially protruded upwardly in the vicinity of the filter 1 and the vicinity of the filter 1 is located so as to be higher than the cooling water supply port Ea of the engine E. The tip end of the tip end potion 2*a* of the supply pipe 2 is connected to the cooling water supply port Ea and the tip end portion 2*a* extends horizontally or downwardly slopes from the cooling water supply port Ea.

In this embodiment, both end portions 2*c*, 2*d* of the upwardly protruded portion 2*e* of the supply pipe 2 are connected to each other by means of a bypass pipe Bp as the bypass passage. The bypass pipe Bp is comprised of a small-diameter pipe sized so that its flow cross-sectional area is substantially equal to about ⅕ of the flow cross-sectional area of the supply pipe 2. The bypass pipe Bp, including a portion connected to the supply pipe 2 on the side of the discharge port 21*d*, is entirely placed so as to be lower than the cooling water supply port Ea.

In this embodiment, the filter 1 is mounted to the deck D by means of a mounting member 46 and screws. Instead, the filter 1 may be mounted to the deck D directly by means of screws or may be mounted to the deck by means of the rubber belt Bb of FIG. 3B.

In the personal watercraft of the third embodiment so constituted, the supply pipe 2 functions as follows.

In the personal watercraft of this embodiment, while the water jet pump P is operating, the cooling water is supplied from the water jet pump P to the engine E through the supply pipe 2. During this supply, sand, waterborne plants, dust, or the like contained in the cooling water is eliminated by the filter 1 provided in the supply pipe 2, thereby allowing clean cooling water to be supplied to the engine E. At this time, as a matter of course, the cooling water is also supplied to the engine E through the bypass pipe Bp, but its flow is considerably little because of its flow cross-sectional area smaller than that of the supply pipe 2. This follows that the substances such as sand and the like contained in the cooling water flowing toward the engine E through the bypass pipe Bp are little. For the purpose of preventing the cooling water from flowing to the engine E through the bypass pipe Bp, as schematically shown in 6, it is desirable to provide a one-way valve 46 in the bypass pipe Bp, which permits only a water flow from the engine E to the water jet pump P. With this constitution, all the cooling water supplied to the engine E passes through the filter 1. In this constitution, the flow cross-sectional of the bypass pipe Bp may be equal to that of the supply pipe 2.

In the personal watercraft constituted as shown in FIG. 5, 6, after cruising for a while, when the riding seat S (see FIGS. 10, 11) is removed to allow the opening 16 to be exposed, the filter 1 mounted to the inner side of the deck D is visible. If the filter 1 is made of the semi-transparent resin, then filtering residue of sand or the like remaining in the filter 1 can be visually checked. If the filter 1 needs to be washed, a hand can be put into through the opening 16 to upwardly take out the filter 1. After being cleaned, the filter 1 can be easily re-mounted at its original position.

Figure 6:
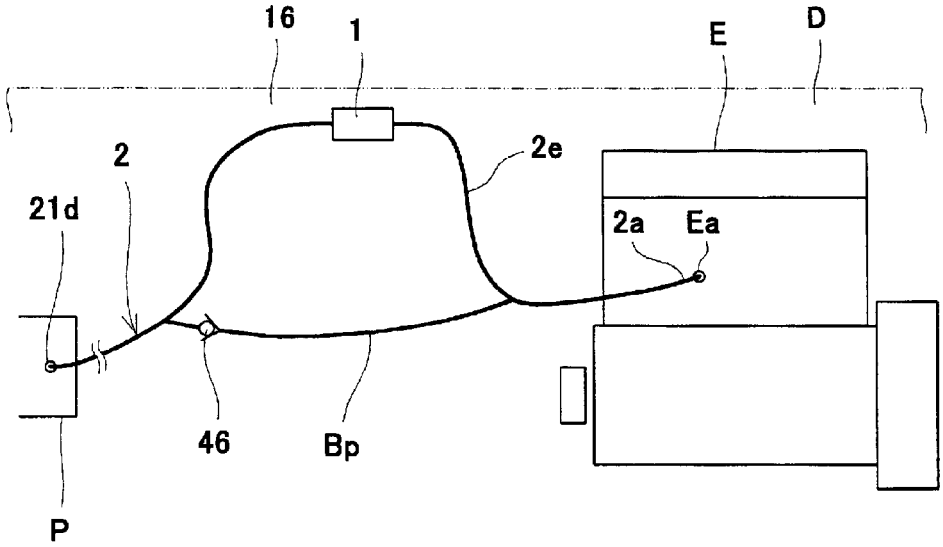
FIG. 6 is a view schematically showing a constitution of a modification of a bypass pipe according to the third embodiment of the present invention.

When the personal watercraft constituted as shown in FIG. 5 or 6 is landed after cruising and horizontally placed, the cooling water in the engine E is caused to travel through the bypass pipe Bp and toward the water jet pump P due to a vertical level difference. Also, the cooling water residing in the supply pipe 2, from the filter 1 to the engine E, is caused to travel toward the water jet pump P. Further, the cooling water residing in the supply pipe 2 on the side of the water jet pump P is caused to travel toward the water jet pump P through the supply pipe 2.

As a result, also in the third embodiment, no cooling water is left in the water jackets of the engine E.

(Embodiment 4)

Figure 7:
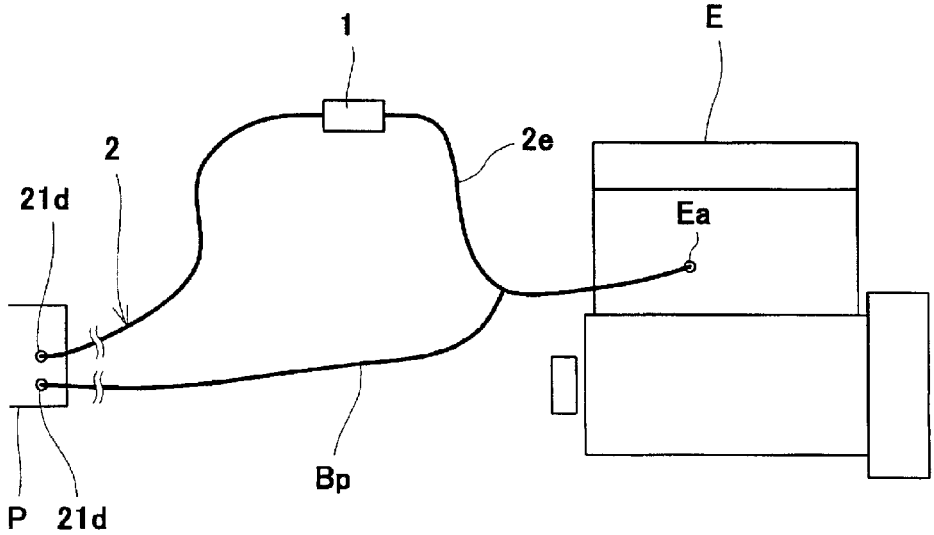
FIG. 7 is a view schematically showing a constitution of an engine cooling system according to a fourth embodiment of the present invention.

As a modification of the third embodiment, as shown in FIG. 7, a base end of the bypass pipe Bp can be directly connected to the discharge port 21*d* of the water jet pump P. In this constitution, there may be provided a one-way valve in the bypass pipe Bp similarly to the constitution of FIG. 6.

(Embodiment 5)

Figure 8:
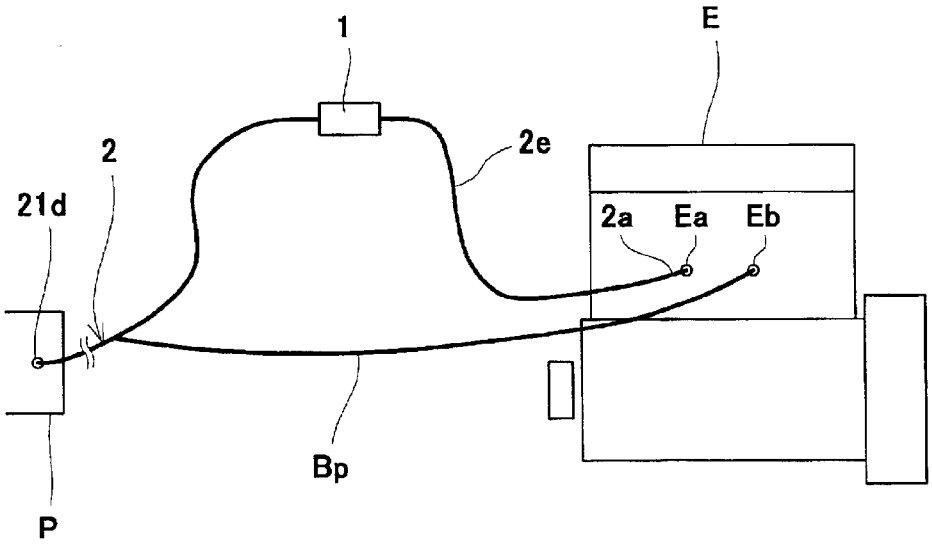
FIG. 8 is a view schematically showing a constitution of an engine cooling system according to a fifth embodiment of the present invention.

As another modification of the third embodiment, as shown in FIG. 8, a tip end of the bypass pipe Bp may be directly connected to another cooling water supply port Eb (second cooling water supply port) of the engine E. Also, in this constitution, the one-way valve may be provided in the bypass pipe Bp similarly to the constitution of FIG. 6.

(Embodiment 6)

Figure 9:
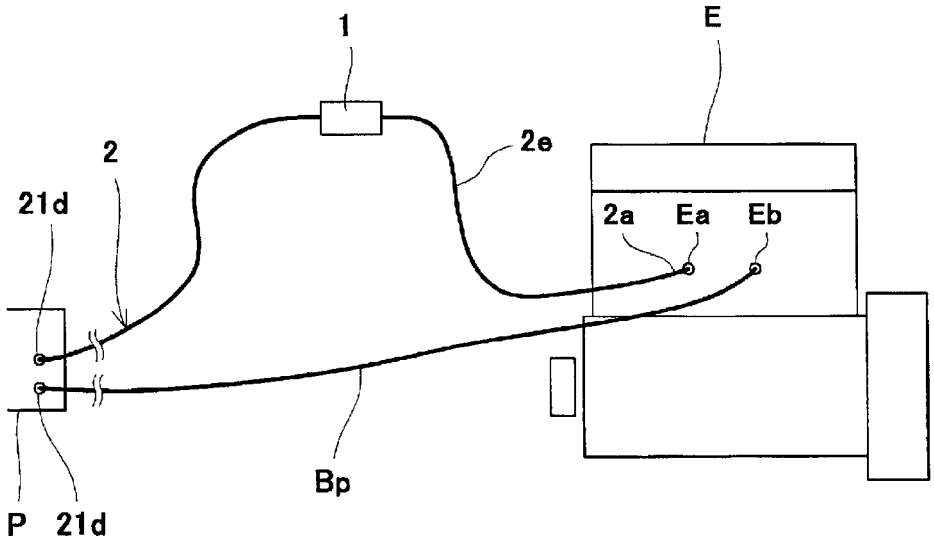
FIG. 9 is a view schematically showing a constitution of an engine cooling system according to a sixth embodiment of the present invention.

As a further modification of the third embodiment, as shown in FIG. 9, a tip end of the bypass pipe Bp may be directly connected to the cooling water supply port Eb of the engine E and a base end of the bypass pipe Bp may be directly connected to the discharge port 21*d* of the water jet pump P. In this constitution, the one-way valve may be provided in the bypass valve Bp similarly to the constitution of FIG. 6. In that case, the bypass pipe Bp functions as a discharge pipe exclusively for discharging the cooling water.

In the personal watercraft according to each of the embodiments, the filter 1 may be comprised of a base portion and a lid member capable of being screwed to the base portion by means of screws. In that case, only the lid member of the filter 1 is removed to clean or replace a filtering member located inside.

Further, the filter 1 may be partially provided with a window portion through which the inside is visible, for the purpose of inspecting how the inside is clogged with substances. In that case, a casing of the filter 1 may be made of an opaque material.

The cooling water supply pipe is not limited to the water jet pump described in the above embodiments. Alternatively, a cooling water supply pump may be additionally provided.

Furthermore, in the embodiments of FIGS. 7, 9, an openable valve may be provided in a tip end of the bypass pipe Bp or on the side of the engine E and a base end of the bypass pipe Bb may be opened toward outside or inside of the watercraft rather than the water jet pump. In this constitution, the valve may be closed during cruising, and opened after cruising, for discharging the cooling water in the engine.

Moreover, in the above-described embodiments, a rubber hose is preferable as the supply pipe 2, because of greater flexibility in providing the same. Alternatively, the supply pipe 2 may be a resin pipe, or a steel pipe such as a copper pipe or a stainless pipe.

Numerous modifications and alternative embodiments of the invention will be apparent to those skilled in the art in view of the foregoing description. Accordingly, the description is to be construed as illustrative only, and is provided for the purpose of teaching those skilled in the art the best mode of carrying out the invention. The details of the structure and/or function may be varied substantially without departing from the spirit of the invention and all modifications which come within the scope of the appended claims are reserved.

What is claimed is:

1. A personal watercraft comprising:

a water jet pump including an outlet port, the water jet pump pressuring and accelerating sucked water and ejecting the water from the outlet port to propel the watercraft as a reaction of the ejecting water;

a riding seat;

a water-cooled engine for driving the water jet pump;

an engine room that contains the engine;

a water supply passage through which cooling water from outside of the watercraft is supplied to the engine; and a filter for filtering substances in the cooling water, wherein:

the engine room is formed in a space surrounded by a hull and a deck of the watercraft, the riding seat is removably attached to cover an opening provided at a location of the deck above the engine room, the water jet pump is used as a cooling water supply pump for supplying the cooling water to the water supply passage, the water supply passage has a water supply pipe configured to connect a cooling water discharge port provided on a pump casing of the water jet pump to a cooling water supply port of the engine, the filter is placed in a portion of the water supply pipe within the engine room so as to be visible through the opening by removing the riding seat; and the water supply pipe has a raised portion extending to be higher than the cooling water discharge port and the cooling water supply port, and the filter is provided along the raised portion.

2. The personal watercraft according to claim 1, wherein the water supply passage has a water bypass pipe configured to flow the cooling water so as to bypass the raised portion of the water supply pipe, and the water bypass pipe is positioned not to be higher than the cooling water supply port.

3. The personal watercraft according to claim 2, wherein the water bypass pipe has a water flow cross-sectional area smaller than a water flow cross-sectional area of the water supply pipe.

4. The personal watercraft according to claim 2, wherein the water bypass pipe is provided with a one-way valve configured to permit flow of the cooling water in the water bypass pipe only in a direction from the cooling water supply port to the cooling water discharge port.

5. The personal watercraft according to claim 2, wherein the water bypass pipe is configured to connect portions of the water supply pipe which are located on both sides of the raised portion.

6. The personal watercraft according to claim 2, wherein the pump casing is provided with a first cooling water discharge port formed by the cooling water discharge port and a second cooling water discharge port, and the water bypass pipe is configured to connect a portion of the water supply pipe, which is located between the raised portion and the cooling water supply port, to the second cooling water discharge port.

7. The personal watercraft according to claim 2, wherein the engine is provided with a first cooling water supply port formed by the cooling water supply port and a second cooling water supply port, and the water bypass pipe is configured to connect a portion of the water supply pipe, which is located between the raised portion and the cooling water discharge port, to the second cooling water supply port.

8. The personal watercraft according to claim 2, wherein the pump casing is provided with a first cooling water discharge port formed by the cooling water discharge port and a second cooling water discharge port, the engine is provided with a first cooling water supply port formed by the cooling water supply port and a second cooling water supply port, and the water bypass pipe is configured to connect the second cooling water discharge port to the second cooling water supply port.

9. A personal watercraft comprising:

a water jet pump including an outlet port, the water jet pump pressuring and accelerating sucked water and ejecting the water from the outlet port to propel the watercraft as a reaction of the ejecting water;

a riding seat;

a water-cooled engine for driving the water jet pump;

an engine room that contains the engine;

a water supply passage through which cooling water from outside of the watercraft is supplied to the engine; and a filter for filtering substances in the cooling water, wherein:

the engine room is formed in a space surrounded by a hull and a deck of the watercraft, the riding seat is removably attached to cover an opening provided at a location of the deck above the engine room, the water jet pump is used as a cooling water supply pump for supplying the cooling water to the water supply passage, the water supply passage has a water supply pipe configured to connect a cooling water discharge port provided on a pump casing of the water jet pump to a cooling water supply port of the engine, and the filter is placed in a portion of the water supply pipe within the engine room so as to be visible through the opening by removing the riding seat;

wherein the water supply pipe has a raised portion extending to be higher than the cooling water discharge port and the cooling water supply port, and the filter is provided in the vicinity of a top portion of the raised portion.

* * * * *